United States Patent [19]

Christensen

[11] 3,964,224

[45] June 22, 1976

[54] PLATE-SHAPED MODULE UNITS

[76] Inventor: Sofus Georg Christensen, 103 Hovedvejen, 2600 Glostrup, Denmark

[22] Filed: Sept. 9, 1974

[21] Appl. No.: 504,246

[52] U.S. Cl. ..... 52/387; 52/391; 52/594

[51] Int. Cl.[2] ..... E04F 13/08; E04C 1/30

[58] Field of Search ..... 52/384–389, 52/390, 391, 392, 593–595

[56] References Cited

UNITED STATES PATENTS

| | | | |
|---|---|---|---|
| 1,692,438 | 11/1928 | Gates | 52/384 |
| 1,864,774 | 6/1932 | Storm | 52/390 |
| 2,223,721 | 12/1940 | Ernstoff | 52/391 |
| 2,251,840 | 8/1941 | Duffy | 52/391 |
| 3,238,682 | 3/1966 | Tracy et al. | 52/387 |
| 3,520,095 | 7/1970 | Jonason et al. | 52/387 |
| 3,657,852 | 4/1972 | Worthington et al. | 52/392 |
| R17,020 | 7/1928 | Healy | 52/387 |

*Primary Examiner*—J. Karl Bell
*Attorney, Agent, or Firm*—Cushman, Darby & Cushman

[57] ABSTRACT

A panel structure for manufacturing plate-shaped module units and elements built thereof comprising a frame and a flat fastening member mounted at one side of said frame, said fastening member forming an open bottom and being provided with projections and indentations to align identical adjacent module units, the purpose of said panel structure being to form a protective and pattern- or relief-forming frame round a finished module unit. The panel structure may be used both for direct mounting of prefabricated module units and as a permanent shuttering in connection with moulding of a module unit of e.g. gypsum or concrete, and two of the outer edges of the frame are provided with tongues, whereas the two other outer edges are provided with corresponding grooves for joining together the frame and similar frames. When a module unit is moulded, the panel structure being a permanent shuttering, the moulding material is poured in through a central opening in the fastening member while other holes therein are subjected to vacuum.

5 Claims, 7 Drawing Figures

PLATE-SHAPED MODULE UNITS

The present invention relates to the manufacturing of slab shaped module units for covering walls, ceilings, floors, table tops, and many similar surfaces. The designation slab shaped module units is to be understood in the widest sense of the word as comprising e.g. ceramic module units, module units of concrete, gypsum, plastics, or other mouldable materials, module units of wood, textiles, glass, or other materials which can be used for covering surfaces and building up wall structures.

It is known in the art to mould module units in moulds or by means of extrusion and similar methods, which, however, often involve high costs and leave the individual module units in a condition, in which they are furthermore exposed to damage to their edges during the process of hardening, during the process of finishing, and during transport. Furthermore, the known module units are often manufactured with considerable tolerances, i.e. without any precise dimensions, have no members for mounting identical module units so that said module units will interlock and be placed in a very accurate position with respect to each other, and have no members for securing the module units to a surface.

An object of the invention is to make it possible to manufacture module units with precisely identical dimensions and module units which can easily be secured in the correct position with respect to each other, when they are used for forming an overall cover or wall surface.

Another object of the invention is to provide a method of conveniently manufacturing module units with well protected edges and corners and units which can be securely linked with similar module units so as to form larger elements with accurate pre-determined dimensions.

Still another object of the present invention is to provide a relatively simple precision panel structure which can be used as a protective and forming frame to provide accurate joints round the covering or filling material proper, said frame having tongues and grooves for interlocking adjacent module units and further being provided with a flat fastening member forming an open bottom in the panel structure and having a central opening, through which moulding material may be poured in, as well as openings which may be subjected to vacuum while moulding material is being poured into the frame through said central opening. Further, the fastening member is provided with means for aligning module units and with members for securing the unit to a surface. Finally, the panel structure frame may be provided with tongues and grooves at the side edges facing the moulding material so as to fix the moulding material in the frame.

Figure 1:
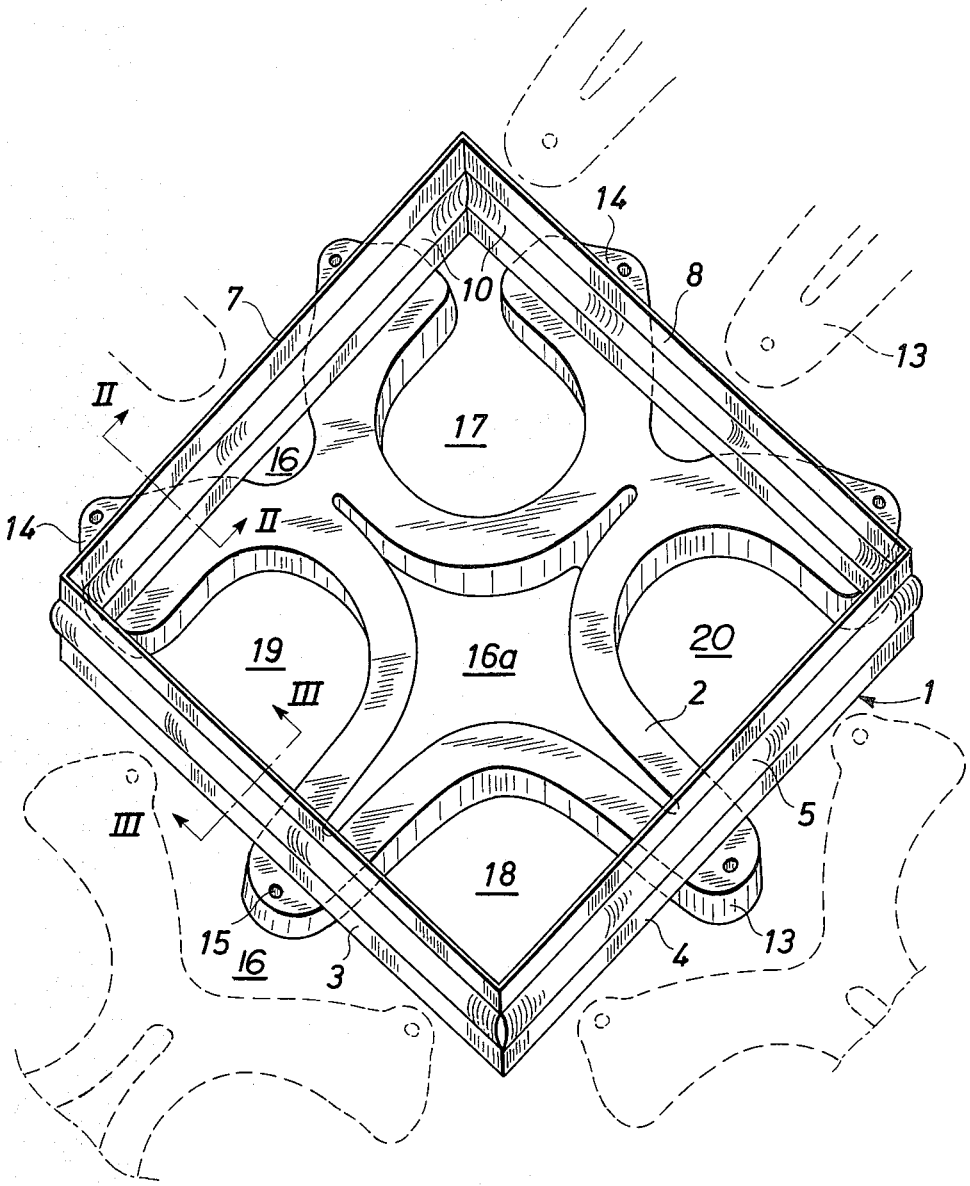
Figure 2:
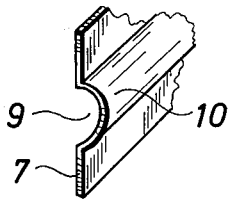
Figure 3:
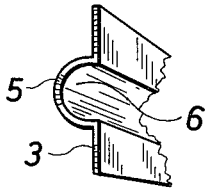
Figure 4:
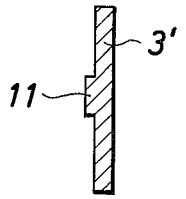
Figure 5:
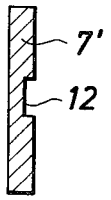
Figure 6:
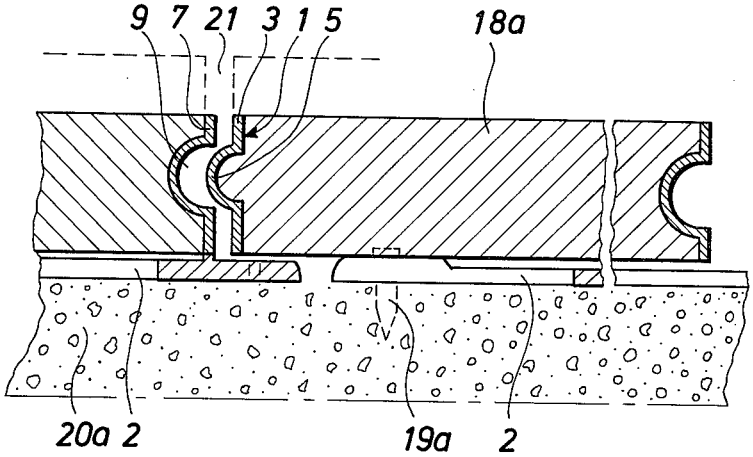
Figure 7:
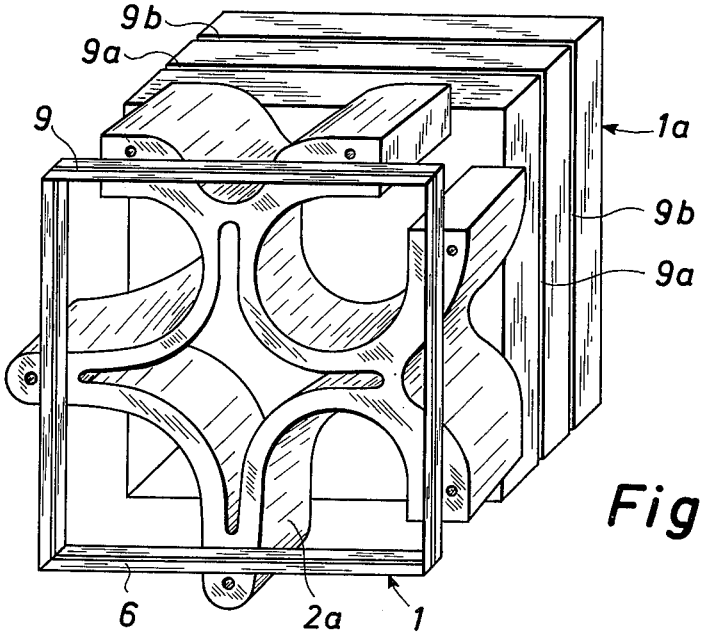

The invention will be described in detail below, reference being had to the accompanying drawings, in which FIG. 1 is a perspective view of an embodiment of a panel structure according to the invention for manufacturing module units, FIGS. 2 and 3 are cross-sections of the sides of the panel structure along the lines II—II and III—III respectively in FIG. 1, FIGS. 4 and 5 are sectional views corresponding to FIGS. 2 and 3 respectively through the sides of a modified embodiment of the panel structure according to the invention, FIG. 6 is a sectional view illustrating the interlocking of two adjacent module units being mounted on a supporting surface, and FIG. 7 is a building element in the form of a double panel structure comprising one fastening member being connected to a frame on both sides.

A module unit may advantageously be manufactured by using the panel structure according to the invention, e.g. the preferred embodiment as shown in FIG. 1. This panel structure comprises a square frame, which as a whole is referred to by the reference numeral 1, and a flat fastening member, which as a whole is referred to by the reference numeral 2, said fastening member being manufactured as an integral part of the frame. It will be understood that the frame may have the shape of an oblong rectangle as well as any other shape, e.g. that of a hexagon. Two adjacent frame sides 3 and 4 respectively are so shaped as to form an outwards extending longitudinal tongue 5, of which the side facing the center of the frame forms a corresponding groove 6, whereas the two other sides 7 and 8 respectively of the frame at their outer sides are provided with a longitudinal groove 9, of which the side facing the center of the frame forms a corresponding tongue 10. The frame 1 is to form a permanent reinforcement around the actual covering material moulded or mounted in said frame 1, and the tongue 5 and the grooves 9 serve the purpose of closely linking the unit with similar adjacent units when the module units are to cover a supporting surface such as a wall or a ceiling. The grooves 6 and the tongues 10 serve the purpose of securing the covering material in the frame, which is preferably made of a mouldable plastic material, aluminum, pressboard, metal, etc. When the unit, as is explained in greater detail below, is moulded direct in the panel structure the material will settle round the tongues 10 and flow into the grooves 6 thereby being secured within the frame after having set. If the module unit is made by the panel structure being assembled together with a prefabricated plate of the covering or filling material said plate may beforehand be provided with corresponding grooves and tongues to be snapped into the frame or the frame may have a smooth inner surface as shown in the sectional drawings FIGS. 4 and 5, in which the reference numeral 11 refers to the tongue and the reference numeral 12 to the grooves, and the covering material may in that case be secured in the panel structure by other means, for instance by being glued to the sides of the frame and to the fastening member 2.

The fastening member 2 forms an open bottom in the panel structure and has projections 13 extending beyond the frame sides 3 and 4 as well as projections 14 extending beyond the frame sides 7 and 8, and these projections have a through-going hole 15 for securing the module unit to a surface. Furthermore, the fastening member 2 has indentations 16 to engage projections 13 of adjacent module units so as to align the module units. By means of dotted lines the drawing shows parts of the fastening members 2 of adjacent panels in order to illustrate the co-operation of the projections and the indentations. It will be understood that units to be joined may also be displaced by half the length of an edge with respect to each other.

Before being mounted on a surface such as a wall or a ceiling the module units may be joined to form larger module elements and may be so positioned with respect to each other that the projections 13 and 14 change regularly along the edges of the element.

When the module unit is made by material being poured into the panel structure 1, said panel structure 1 is turned so that the fastening member 2 faces upwards, the panel structure 1 being placed on a bottom plate or tray, whereafter the material is poured through a central opening 16*a*, the surrounding openings 17, 18, 19, and 20 being subjected to vacuum so that the material spreads and combines with the frame. The bottom plate, which is not shown, may be smooth or it may have been given such a form that a pattern or a relief will be formed on the outer surface of the finished module unit.

FIG. 6 shows to the right a finished module unit comprising moulded material 18*a*, a panel structure 1 and a fastening member 2, by way of which the module unit is secured to a surface, e.g. a wall 20*a*, by means of screws 19*a*. The figure shows to the left another module unit in the process of being mounted immediately before the groove 9 of one of its side edges is caused to engage the tongue 5 of the secured module unit. The tongue-and-groove joint makes the module units interlock securely and forms a completely tight joint, and the frame sides 3 and 7 respectively serve the additional purpose of reinforcing the plate edges also to facilitate the mounting of the module units as they form "joints" with exactly the same thickness all the way round. It will be understood that, if desired, it would also be possible to mould the covering or building material so that said material will have a thickness exceeding the height of the frame as is suggested by means of dotted lines in FIG. 6. Also in this instance the frame sides 3 and 7 define very accurately the thickness of joints 21, which can be filled in a usual way after the mounting of the module units, should this be desired.

In addition to an industrial production the panel structure according to FIG. 1 may be manufactured by being moulded in situ, the panel structure for instance being secured to a wall of relatively primitive material before the moulding. This provides among other things a highly adhesive plaster covering of a surface which in this way is divided up into sections corresponding to the module unit.

In addition to its use for covering floors, ceilings, and walls the module unit according to the invention may advantageously be used for manufacturing for instance tile-topped tables and for many different forms of mosaic works. Finally, assembled to larger module elements the module unit may be used for construction purposes.

FIG. 7 shows a special embodiment of the panel structure according to the invention here forming a building element of considerable thickness. The module unit here forms a double panel structure, the fastening member 2*a*, which at one side is connected to the relatively thin frame 1, carrying at its opposite sides a wider frame 1*a* having outside grooves 9*a* and 9*b* respectively at the two frame sides shown and having corresponding tongues at the two frame sides not shown. It will be understood that depending on its width the frame 1*a* may be provided with a number of grooves. Hereby is provided a precision building element which, if desired, at one side of the fastening member can have a thickness like that of a supporting wall and which at the other side can have thin plate shaped material. The grooves and the tongues may form interlocking members being so strong as to render superfluous any mortaring of the building elements.

It will be understood that the panel structure may be modified in several ways within the scope of the invention by changing the number and the width of the frame sides and by changing the shape and the width of the fastening member 2.

I claim:

1. A square or rectangular module unit for covering walls, ceilings, and similar surfaces with slabs, the back of said module unit being provided with a fastening member, which has lateral projections to align identical module units, said projections extending beyond two adjacent edges of the module unit and at the two other edges being provided with similar indentations for receiving projections of the fastening member of the adjacent module unit, said indentations facing the center of the module unit, wherein the fastening member is connected to a square or rectangular frame, of which the sides form protective means all along the periphery of the module unit, two adjacent sides having longitudinal tongues projecting therefrom and the other two adjacent sides having longitudinal grooves for connecting the module unit to adjacent module units.

2. A module unit as claimed in claim 1 wherein the fastening member, which at one side is connected to said frame, is at its opposite side connected to another frame having the same outline, but having greater width and a larger number of grooves and tongues.

3. A module unit as claimed in claim 1, including material molded inside the frame, the fastening member being connected to the material inside the frame by means of a tongue-and-groove joint, the grooves forming tongues on the outer surface of two frame sides and form corresponding tongues on the inner surface thereof, and wherein tongues are formed on the outer surface of the other two frame sides and form corresponding grooves on the inner surface thereof.

4. A square or rectangular module panel structure for use on walls, windows or floors comprised of a top frame member having a fastening member integrally connected to the bottom thereof wherein said top frame member is comprised of four side walls, two adjacent side walls being provided with a longitudinal tongue, the other two adjacent side walls being provided with a longitudinal groove and wherein said bottom fastening member is provided with two adjacent alignment projections and with two adjacent alignment indentations, said bottom fastening member being connected to the top frame member such that said projections extend beyond two adjacent side walls of said top member and said indentations are aligned with the other two adjacent side walls of said top member.

5. A panel structure as claimed in claim 4 wherein the cross-sectional shape of tongue and groove is that of a rounded U, a groove facing the center of the panel structure being formed in the frame sides which are provided with an outside tongue, and, conversely, a tongue facing the center of the panel structure being formed at the frame sides which are provided with an outside groove.

* * * * *